US005763964A

United States Patent [19]

Rotta

[11] Patent Number: 5,763,964

[45] Date of Patent: Jun. 9, 1998

[54] DISTRIBUTED NEON POWER SUPPLY SYSTEM

[75] Inventor: Martin Rotta, South Milwaukee, Wis.

[73] Assignee: Everbrite, Inc., Greenfield, Wis.

[21] Appl. No.: 807,002

[22] Filed: Feb. 26, 1997

Related U.S. Application Data

[63] Continuation of Ser. No. 294,443, Aug. 23, 1994, abandoned.

[51] Int. Cl.[6] ..... H05B 37/02

[52] U.S. Cl. ..... 307/157; 313/582; 315/169.3; 315/276; 315/DIG. 5; 315/DIG. 7; 315/250; 315/254; 315/312; 315/178; 40/545; 40/614

[58] Field of Search ..... 307/157; 313/582; 315/169.3, DIG. 5, DIG. 7, 276, 250, 254, 257, 274, 282, 323, 312, 178, 184; 345/121, 122, 31; 40/596, 614, 545

[56] References Cited

U.S. PATENT DOCUMENTS

| | | | |
|---|---|---|---|
| 2,731,585 | 1/1956 | Rousseau | 40/545 |
| 5,045,760 | 9/1991 | Teresinski | 315/DIG. 7 |
| 5,126,637 | 6/1992 | Watts et al. | 315/DIG. 7 |
| 5,367,224 | 11/1994 | Pacholok | 315/276 |
| 5,367,225 | 11/1994 | Pacholok et al. | 315/DIG. 5 |

*Primary Examiner*—William M. Shoop, Jr.
*Assistant Examiner*—Albert W. Paladini
*Attorney, Agent, or Firm*—R. W. Slater

[57] ABSTRACT

A high frequency power supply for distributed luminous tube signage including a master power unit and one or more slave units. The master unit includes a digital oscillator, controller, and electronic switches to induce a switched high frequency waveform across the primary of an output transformer. This waveform is preferably of a non-symmetrical variety to minimize neon bubble formation and mercury gas migration. The output transformer includes one or more low voltage ancillary power outputs for interconnection through appropriate twisted pairs or other transmission medium to the slave units. A high voltage secondary for direct luminous tube connection may also be provided. Various slave unit topologies are contemplated including remote or moving luminous tube segments; electronic controllers and sequencers, and motors. The slave units will generally incorporate a small high frequency transformer and rectifiers, filters, regulators and integrated circuits as required for the specific distributed neon or remote function undertaken.

7 Claims, 1 Drawing Sheet

DISTRIBUTED NEON POWER SUPPLY SYSTEM

This application is a continuation of application Ser. No. 08/294,443 filed Aug. 23, 1994, now abandoned.

BACKGROUND OF THE INVENTION

The present invention relates to high frequency power supplies for use in connection with neon and similar luminous tube devices and associated accessories. Conventionally, high frequency supplies provide the source of high voltage required to illuminate one or more luminous tube segments. These segments are preferably arranged in relatively close proximity to the source of high voltage, i.e. the power supply itself, in order to avoid the complexities of high voltage transmission.

The present invention pertains to an improved high frequency supply in which the luminous tube segments may be remotely located at some distance from the principal or 'master' high frequency supply (or from one-another) and in which one or more accessory devices can additionally be powered from the supply (both low and high voltage devices) and similarly remotely located. In addition, the present technology permits greater flexibility in the design of advertising and decorative neon signage in that tube segments may be in relative movement to one another (e.g. clock hands) without resort to high voltage 'slip ring' interconnections or other and cumbersome high voltage flexible connections.

The present distributed neon power supply is preferably of the switched 'digital' type wherein the high voltage output is derived from a generally conventional step-up transformer, the primary of which is driven from a digitally gated switch arrangement. One or more coupled low voltage secondary windings are provided and serve as the source of 'ancillary' power for the distributed neon segments and/or the other powered devices. These ancillary windings may be symmetrically wound or provided in symmetrical pairs on the transformer to minimize overall supply imbalance which imbalance could, in turn, result in falsing of the ground fault interrupter circuitry associated with the supply.

In view of the above-described supply topology, each ancillary output defines a substantially constant voltage, high frequency source of predetermined voltage, typically in the order of 30 $V_{rms}$. The maximum power available is limited only by the design constraints of the master supply with its associated high frequency output transformer. Due to the low voltage of these ancillary outputs, the power therefrom may be routed and distributed to the associated distributed devices—even at some physical distance from the master supply itself—consistently with underlying legal codes and testing agency safety requirements. And in the case of a ancillary device which, while proximal to the master supply, is in relative motion thereto, the low voltage ancillary power facilitates comparative simplicity in the interconnection therebetween.

The ancillary power is, as noted, of the same high frequency as the master supply (typically between 20–30 KHz) and therefore interconnection of these outputs to their respective devices or 'loads' is preferably achieved through standard transmission line techniques, for example, twisted pairs. This same high frequency transmission feature is important to the present invention by reason that the conversion of this energy at the remote or 'slave' end of the transmission line is greatly simplified due to the corresponding small size and weight of the transformers generally associated therewith.

Thus a small high frequency step-up transformer is all that is required at the slave unit to effect illumination of a remotely positioned or movable neon tube segment. And, an equally small transformer—or possibly no transformer at all—in combination with appropriate rectifiers, filters, and/or regulators is all that is required to provide the 'dc' power necessary to operate motors, electronic controls including microprocessors, or other distributed devices. Indeed, for example, it is now possible to create the 'impression of motion' in a neon sign through the sequencing of neon segments in a substantially less expensive manner than in the past. A single master supply provides the low voltage, high frequency energy to each neon segment as well as the dc power to the processor that effects the sequenced switching of the low voltage to each neon segment.

One known distributed neon system was proposed by Hancock, U.S. Pat. No. 4,488,090. Hancock, however, did not teach a master-slave approach in which, essentially, a single supply or master could be used to power each of the remote segments. Rather, Hancock merely employed a line-frequency step-down transformer and distributed the resulting 60 Hz energy to the remote sign elements at which plural locations complete high frequency power supplies were provided. In Zarate, U.S. Pat. No. 4,904,904, the possibility of multiple output transformers is disclosed. The Zarate approach, however, is deemed impractical both due to the cost of the multiple output transformers and, importantly, to the requirement that relatively high voltage switched DC must be remotely routed to each of such transformers.

Applicant previously fabricated a distributed neon sign in the form of a clock with moving neon hands. Applicant's clock, however, employed conventional high voltage distribution to the moving hands including capacitor elements to limit the current thereto. This arrangement proved unsatisfactory due to arcing and the problems outlined above related to the interconnection of high voltage to a moving neon segment. An improved clock employing the teachings of this invention is disclosed herein as an exemplary use thereof.

It is therefore an object of the present invention to provide an improved and less expensive means for distributed neon lighting. It is a further object to minimize the possibilities of electrical shock and to simultaneously conform to known standards for low voltage transmission as set forth by appropriate codes and testing agencies. It is an object to utilize a single supply for plural lighting segments and other devices and to minimize the overall number of supplies required. It is yet another object to employ a sufficiently high frequency distribution arrangement whereby the distributed power may be transformed in higher voltage ac, or into dc, with the smallest of transformers and filtering components. It is an object to permit the inclusion of multiple neon segments, both remotely positioned and positioned for relative motion, and to provide auxiliary power for electronics, microprocessors, motors, and the like.

DESCRIPTION OF THE PREFERRED EMBODIMENT

Figure 1:
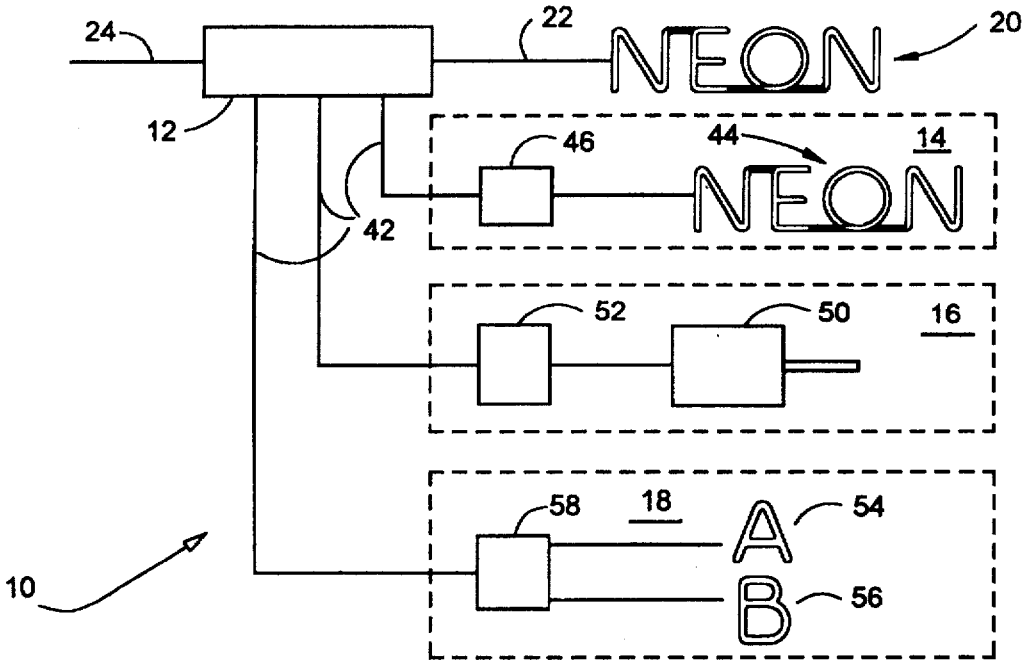
FIG. 1 is a block representation of the distributed neon power supply of the present invention depicting use of multiple slave loads including conventional neon, remote positioned neon, electronic control and motors.

FIG. 1 illustrates the distributed neon high frequency power supply 10 of the present invention including a master high frequency power unit 12 and plural slave units 14, 16, and 18. Also shown is a neon luminous tube 20 interconnected to a conventional high voltage output 22 of the master unit 12. Standard 50/60 Hz line power is provided at 24.

Figure 2:
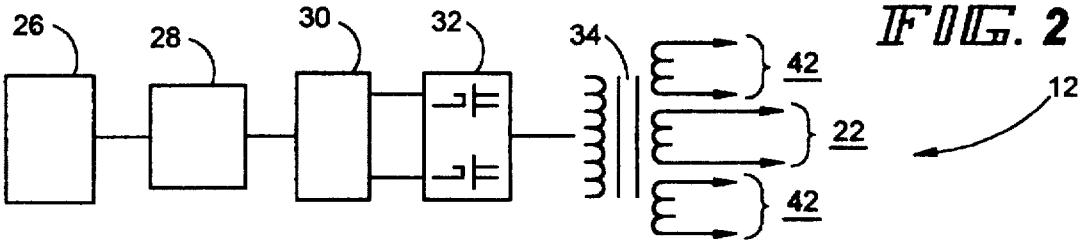
FIG. 2 is a block representation of the master unit of the present invention; and, FIG. 3 is a front elevation view of neon illuminated clock employing the distributed neon, master/slave technology of the present invention.

The master high frequency power unit 12 is shown in FIG. 2 and includes a generally low power digital oscillator 26 preferably operating at a frequency above about 20 KHz. The output from oscillator 26 is passed through an asymmetry-inducing controller 28, in turn, to FET driver 30 and FET switches 32 whereby an asymmetrical high frequency waveform is applied to the primary of output transformer 34. The desirability of providing asymmetrical waveforms in connection with the minimization of mercury migration and neon bubble formation, as well as a further details concerning such oscillators, are described in U.S. Pat. No. 5,189,343. As the specific details of generating a digitally switched high frequency drive source for a luminous tube power supply (e.g. items 26 through 32, herein) are not central to the present invention, no further discussion of this circuitry is included herein. The reader is directed to the above-referenced patent which is hereby incorporated by reference as part of this specification.

As noted, output transformer 34 may include a conventional high voltage output 22 suitable for direct connection to a luminous tube segment 20 (FIGS. 1 and 2). One such example of the combined use of conventional and distributed neon segments is the clock of FIG. 3 in which the circular neon segment 36 defined around the perimeter of the clock face is interconnected to the high voltage output 22 of master power unit 12 in conventional fashion. The clock hands 38 and 40, as described in more detail below, are distributed neon segments of the movable variety.

Referring again to FIGS. 1 and 2, master unit 12 includes one or more ancillary power outputs 42. Ancillary outputs 42 are similarly of high frequency, but of relatively low voltage, e.g. 30 $V_{rms}$ or less, thereby permitting the transfer of electric energy therefrom to slave units 14, 16, 18 (FIG. 1), or the movable slave units such as clock hands 38 and 40 (FIG. 3), without the need for cumbersome insulation or high voltage slip-joint connections and, further, at some distance from the master unit while remaining in compliance with pertinent codes and licensing agency requirements.

It will be appreciated that great flexibility in the design of neon lighting and signage is now economically feasible employing the present technology. Indeed, this is true even for so-called 'straight' neon/mercury signs, i.e. simple glass signs without added electronics, control circuits, or motors. For example, although slave unit 14 includes a neon segment 44 substantially of the same character as neon segment 20, slave unit 14 may be positioned remotely from the remainder of the sign, in particular, master unit 12. Ordinarily the positioning of conventional luminous segments at some distance from the high voltage source must be avoided due to the necessity of conveying high voltage thereto. The low voltage/high frequency ancillary power from output 42 of the present invention, by contrast, may be conveyed any reasonable distance (e.g. 10–100 feet, or more) to the remote slave unit 14 through, for example, a twisted-pair of conductors.

Figure 3:
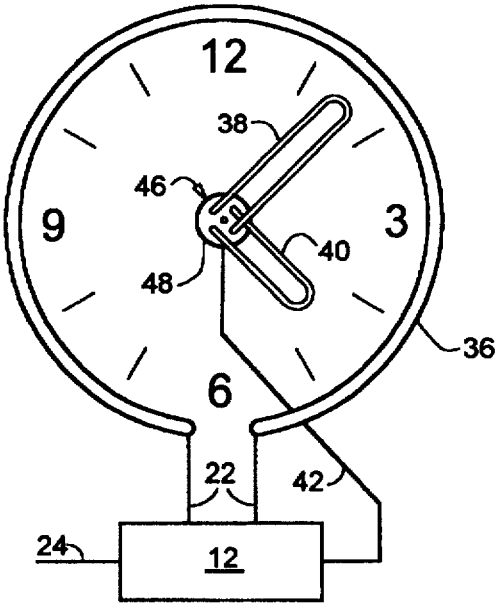

The use of the present distributed neon technology finds application even where the slaved neon segment remains relatively proximal to the master unit 12. The clock of FIG. 3 is exemplary of such a use, in particular, clock hands 38 and 40. These hands, although positioned in relatively close proximity to the master unit 12, nevertheless present a challenge to the conventional high voltage interconnection by reason of the necessity of providing high voltage slip-ring interconnections to the continuously rotating hands. The clock of FIG. 3, by contrast, interconnects the low voltage ancillary power 42 to the rotating clock hands through a pair of low voltage slip-rings (not shown).

Both the slaved clock hands 38, 40 (FIG. 3) and the remote neon segment 44 (FIG. 1) include a small high frequency step-up transformer 46 immediately adjacent to the respective neon segments to provide the appropriate voltage conversion necessary for luminous tube excitation. It will be understood that a small motor and gear assembly 48 are also provided at the pivot point of the clock hands to effect the timed rotation of these hands (i.e. to keep time). Such a motor may advantageously be driven from, and controlled by, ancillary circuitry of the type described hereinafter and therefore a single slip-ring interconnection of ancillary power may, in the case of the clock, power multiple slaved units.

Slave unit 16 (FIG. 1) illustrates another capability of the present distributed neon technology. Indeed, 'distributed neon' is somewhat a misnomer in this case as slave unit 16 includes no neon nor, for that matter, any other high voltage device. Rather, slave unit 16 defines a motor drive/control module comprised of motor 50 and motor power supply and/or controller 52.

It is often advantageous to have reciprocating or other moving sign elements incorporated into the design of the neon display sign. The present invention provides the flexibility to power virtually any motor configuration—all from the same, common master unit 12.

First, and possibly most common, is the dc motor. In this embodiment, motor 50 would preferably be a low voltage dc motor powered from a small dc converter/controller 52. Converter/controller 52, in its simplest form, would be a rectifier and/or filter combination to convert the high frequency, low voltage ancillary power to the required dc. A small high frequency transformer may be included should a higher or different dc potential be required. Converter/controller 52 may additionally include control circuitry to turn motor 50 'on' at predetermined intervals to, for example, rotate triangular sign elements to expose, in sequence, differing pictures or slogans. The design of power supplies and electronic timers/controllers is well-known and is not therefore considered further herein.

Motor 50 is further representative of the clock motor shown in FIG. 3. In this connection the motor may be dc, ac, or a stepper motor. And depending on the specific motor technology selected, supply/controller 50 would serve, again employing techniques well known to the artisan, to generate the required ac/dc/pulsed voltage and at the appropriate frequency and/or repetition rate to drive the clock hands in synchronization to 'time' itself. Again, the clock of FIG. 3 may advantageously incorporate two slave units, a unit 14 to power the 'neon' rotating hands and a unit 16 to power and drive the clock hand motor.

Still referring to FIG. 1, yet another contemplated slave unit 18 is shown including, merely by way of example, two neon letters or segments, 54 and 56. Slave unit 18 is intended to be illustrative of the so-called 'apparent motion' neon signs in which, literally, apparent motion is achieved by the sequenced illumination of neon segments, 54 and 56 in the present example. It will be understood that 'apparent motion' signs may include any number of sequenced neon segments and, in fact, generally include more than two such segments. Some well know examples of apparent motion promotional neon signs include the 'bowling sign' in which the bowling pins are toppled and the 'arrow or lightning sign' in which an arrow or a bolt of lightning is seen to progress across the sign.

The present technology greatly simplifies implementation of these multiple neon segment 'apparent motion' signs by limiting the number of power supplies required. Existing 'apparent motion' embodiments have employed as many as a dozen or more separate supplies—one for each segment—which supplies are energized by a sequencer. The distributed neon 'apparent motion' sign of FIG. 1, by contrast, utilizes a single master supply unit 12 with, in the preferred embodiment, a single ancillary output 48 interconnected to the slaved sequencer or unit 18.

More specifically, slave unit 18 further includes a sequencer/supply 58 that serves two functions—it transforms the low voltage ancillary power into the required high voltage to drive the respective neon elements and it gates the various neon elements "on" in accordance with the predetermined sequence required. The gating function is preferably performed prior to the above-noted low-to-high voltage transformation. Thus, the controller/sequencer gates the low voltage energy to each of the neon segments—each segment, in fact, defining a type 14 slaved unit, i.e. one having a small high frequency step-up transformer associated therewith. The controller/sequencer may preferably be a microcontroller integrated circuit having plural outputs which, in turn, energize relays or other solid state switches to enable/power the associated neon segment slaved units. The programming and design of micro-controllers and sequencers is well known to those knowledgeable in the art.

It is thought that the invention and many of its attendant advantages will be understood from the foregoing description, and it is apparent that various changes may be made in the form, construction and arrangement of its component parts without departing from the spirit and scope of the invention or sacrificing all of its material advantages, the forms described being merely preferred embodiments thereof.

In view of the above, we wish to be limited not by the specific embodiment illustrated but only by the scope of the appended claims wherein it is claimed:

1. A distributed luminous tube power supply for signage elements and the like having a master unit and at least one slave unit for connection to a signage element, said slave unit remotely oriented with respect to the master unit; the master unit including a dc supply for converting standard line ac power into a dc voltage, an ultrasonic frequency oscillator and an output transformer having a primary winding and at least one ancillary power secondary winding; means connected to the oscillator and dc supply for impressing an ac waveform of said ultrasonic frequency across the transformer primary; each slave unit including input means for receiving ancillary power and output means for direct interconnection to a signage element; transmission means for interconnecting an ancillary power winding of the master unit to each remote slave unit input means; each slave unit including means for converting the transmitted ancillary power at the input means to an energy waveform at the output means for operating a signage element whereby such element may be operated at a distance spaced from the master unit or another element and may be in relative motion with respect to the master unit or another element.

2. The distributed luminous tube power supply of claim 1 in which the master unit output transformer includes a high voltage secondary output means for direct interconnection to a luminous tube proximal thereto whereby a proximal luminous tube and at least one signage element may be operated from a single master unit.

3. The distributed luminous tube power supply of claim 1 in which the transmission means is a twisted pair of conductors whereby a signage element is powered by an ultrasonic frequency, low voltage interconnection between the master and slave units.

4. The distributed luminous tube power supply of claim 1 in which at least one of the slave unit converting means includes an ultrasonic frequency step-up transformer for connection to a luminous tube segment whereby said segment is spaced remotely from, or operated in relative motion with respect to, the master unit.

5. The distributed luminous tube power supply of claim 1 in which at least one of the slave unit converting means includes a power supply means for connection to a motor whereby portions of the neon sign are adapted to be operated in relative relationship to one-another.

6. The distributed luminous tube power supply of claim 1 in which at least one of the slave unit converting means includes controller means for selectively enabling the output means whereby signage elements are selectively and sequentially operated.

7. A distributed luminous tube power supply for signage elements and the like having a master unit and at least one slave unit for connection to a signage element, said slave unit remotely oriented with respect to the master unit; the master unit including a dc supply for converting standard line ac power into a dc voltage, an ultrasonic frequency low power oscillator, an output transformer having a primary winding and at least one ancillary power secondary winding, said ancillary winding producing an ultrasonic frequency ac output of relatively low voltage, generally less than about 50 $V_{rms}$; switch means connected to the oscillator and dc supply for applying and alternately reversing the polarity of the dc to the transformer primary in correspondence to said oscillator ultrasonic frequency; each slave unit including input means for receiving ancillary power and output means for direct interconnection to a signage element; transmission means for interconnecting an ancillary power winding of the master unit to each remote slave unit input means; each slave unit including means for converting the transmitted ancillary power at the input means to an energy waveform at the output means for operating a signage element whereby such device may be operated at a distance spaced from the master unit or another element.

* * * * *